US010961753B2

(12) United States Patent
Han

(10) Patent No.: US 10,961,753 B2
(45) **Date of Patent: *Mar. 30, 2021**

(54) RETRACTABLE OUTSIDE DOOR HANDLE ASSEMBLY FOR VEHICLE

(71) Applicants: Hyundai Motor Company, Seoul (KR); Kia Motors Corporation, Seoul (KR)

(72) Inventor: Jungho Han, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 232 days.

This patent is subject to a terminal disclaimer.

(21) Appl. No.: 16/193,964

(22) Filed: Nov. 16, 2018

(65) Prior Publication Data

US 2020/0115935 A1 Apr. 16, 2020

(30) Foreign Application Priority Data

Oct. 11, 2018 (KR) ..... 10-2018-0120849

(51) Int. Cl.
*E05B 85/10* (2014.01)
*E05B 85/06* (2014.01)
(Continued)

(52) U.S. Cl.
CPC ..... *E05B 85/107* (2013.01); *E05B 81/90* (2013.01); *E05B 85/06* (2013.01); *E05B 85/103* (2013.01); *E05Y 2900/531* (2013.01)

(58) Field of Classification Search
CPC ..... E05B 85/107; E05B 85/103; E05B 81/90; E05B 85/06; E05B 85/10; E05B 5/00;
(Continued)

(56) References Cited

U.S. PATENT DOCUMENTS 8,807,807 B2 * 8/2014 Wheeler ..... E05B 1/0092 362/501
8,919,047 B2 * 12/2014 Johnsrud ..... E05B 85/107 49/503

(Continued)

FOREIGN PATENT DOCUMENTS

CN 102061833 A 5/2011
CN 103132874 A 6/2013

(Continued)

*Primary Examiner* — Lloyd A Gall
(74) *Attorney, Agent, or Firm* — Slater Matsil, LLP

(57) ABSTRACT

A retractable outside door handle assembly for a vehicle according to an exemplary embodiment of the present invention may include an outside door handle protruded outward in a width direction of a vehicle rather than a door outer panel configuring a door of the vehicle or being receivable to an opening formed at the door outer panel. A first link has one end connected to one end of the outside door handle and the other end extending downward along a height direction of the vehicle. A second link has one end connected to one side and the other side of the outside door handle and the other end extending along the height direction of the vehicle. A main arm has one end rotatably connected to the door outer panel and the other end connected to the second link.

20 Claims, 12 Drawing Sheets

(51) Int. Cl.
*E05B 81/90* (2014.01)
*E05B 79/12* (2014.01)

(58) Field of Classification Search
CPC ..... E05B 5/003; E05B 5/006; E05B 81/64; E05B 81/76; E05B 81/77; E05B 81/78; E05B 79/06; E05B 79/12; E05B 79/22; E05Y 2900/531; Y10S 292/31; Y10S 292/25
USPC ..... 70/208, 278.7, 279.1; 16/113.1, 405, 16/412, 414, 429; 292/336.3, 347, 292/DIG. 31, DIG. 63
See application file for complete search history.

(56) References Cited

U.S. PATENT DOCUMENTS

| | | | | |
|---|---|---|---|---|
| 9,080,352 | B2 * | 7/2015 | Aerts | E05B 85/18 |
| 9,103,143 | B2 | 8/2015 | Wheeler et al. | |
| 9,249,608 | B2 * | 2/2016 | Lang | E05B 85/107 |
| 2008/0163555 | A1 * | 7/2008 | Thomas | E05B 85/103 49/460 |
| 2010/0127516 | A1 * | 5/2010 | Fannon | E05B 85/16 292/336.3 |
| 2011/0115240 | A1 | 5/2011 | Müller et al. | |
| 2013/0076048 | A1 * | 3/2013 | Aerts | G07C 9/00944 292/336.3 |
| 2013/0125472 | A1 | 5/2013 | Polewarczyk et al. | |
| 2013/0127185 | A1 * | 5/2013 | Lang | E05B 85/103 292/336.3 |
| 2013/0241215 | A1 * | 9/2013 | Halliwell | E05B 85/107 292/336.3 |
| 2016/0222705 | A1 * | 8/2016 | Velicanin | E05B 81/06 |
| 2016/0281397 | A1 | 9/2016 | Park et al. | |
| 2016/0298366 | A1 | 10/2016 | Och | |
| 2018/0058113 | A1 | 3/2018 | Han et al. | |
| 2019/0234122 | A1 * | 8/2019 | Low | E05B 85/103 |
| 2020/0071973 | A1 * | 3/2020 | Han | E05B 79/06 |

FOREIGN PATENT DOCUMENTS

| | | | |
|---|---|---|---|
| CN | 105507699 | A | 4/2016 |
| CN | 105637162 | A | 6/2016 |
| DE | 19833168 | A1 | 2/2000 |
| WO | 2018010939 | A1 | 1/2018 |

* cited by examiner

RETRACTABLE OUTSIDE DOOR HANDLE ASSEMBLY FOR VEHICLE

CROSS-REFERENCE TO RELATED APPLICATIONS

This application claims priority to Korean Patent Application No. 10-2018-0120849, filed in the Korean Intellectual Property Office on Oct. 11, 2018, which application is hereby incorporated herein by reference.

TECHNICAL FIELD

Embodiments of the present invention relate to a retractable outside door handle assembly for a vehicle.

BACKGROUND

In general, a vehicle has a predetermined size of cabin formed therein for boarding of a driver and accompanying occupants, and cabin opening/closing doors are provided for opening/closing the cabin.

For easily opening and closing the cabin opening/closing door by the passenger, an inside door handle is mounted on an inside face toward a cabin inside of the door, and an outside door handle is mounted on an outside face toward a cabin outside of the door.

Each door handle is connected to be interworked with a door latch to fix the door to a vehicle body, such that the door may be opened while the door latch is released according to an operation of each door handle.

The outside door handle is generally mounted to be pivotally movable to the outer panel of the door, and in this case, the outside door handle is installed on the door outer panel to be protruded outside along a width direction of the vehicle so that the passenger may easily hold the outside door handle.

As above-described, if the outside door handle is installed to be protruded outside along a width direction of the vehicle, operation convenience of the passenger is improved, however exterior beauty of the vehicle may be deteriorated due to the protruded outside door handle, also, a running noise may not be only caused in traveling of the vehicle, but also running performance may be also deteriorated due to running resistance.

Recently, to solve these problems, a retractable outside door handle, in which the outside door handle is protruded outside along the width direction of the vehicle from the door outer panel or is received inside a receiving hole formed in the door outer panel by the driving of an actuator (a motor) to not be protruded from the door outer panel outside, has been developed.

The conventional retractable outside door handle assembly may have the outside door handle protrude from the door outer panel via a link mechanism or may receive it inside the receiving hole of the door outer panel through the actuator, and is connected to a door lock mechanism including a key cylinder capable of being operated for locking or releasing the door to the vehicle body and a door latch mechanism directly locking or releasing the door to/from the vehicle body.

However, in the structure of the conventional retractable outside door handle assembly, since the link mechanism retracting the outside door handle is configured of four-node links, to elongate a protruding length of the outside door handle for the operation convenience of the user, the length of the four-node links must be long, and accordingly, since the size of the handle housing must be increased, there are drawbacks that weight and cost are increased and the exterior beauty of the protruded outside door handle is also not satisfied.

The above information disclosed in this Background section is only for enhancement of understanding of the background of the invention and therefore it may contain information that does not form the prior art that is already known in this country to a person of ordinary skill in the art.

SUMMARY

Embodiments of the present invention relate to a retractable outside door handle assembly for a vehicle. Particularly embodiments of the present invention relate to a retractable outside door handle assembly for a vehicle, in which an outside door handle is received inside a door outer panel or is protruded outside the door outer panel.

An exemplary embodiment of the present invention provides the retractable outside door handle assembly for the vehicle, in which a stroke of the outside handle may be made longer with a vertically short layout, a freedom degree of design may not only be improved but also operation reliability is also improved as the outside handle is linearly protruded and received, and a connectivity with other parts such as the door latch is improved, thereby being widely used.

A retractable outside door handle assembly for a vehicle according to an exemplary embodiment of the present invention may include an outside door handle protruded outward in a width direction of a vehicle rather than a door outer panel configuring a door of the vehicle or being receivable to an opening formed at the door outer panel. A first link has one end connected to one end of the outside door handle and the other end extending downward along a height direction of the vehicle. A second link has one end connected to one side and the other side of the outside door handle and the other end extending along the height direction of the vehicle. A main arm has one end rotatably connected to the door outer panel and the other end connected to the second link. A moving block is connected to the other end of the first link and the other end of the second link and is movable up and down along the height direction of the vehicle. A guide mechanism guides the movement of the outside door handle along the width direction of the vehicle.

An actuator pushing up above the moving block along the height direction of the vehicle may be further included.

The actuator may include an actuator rod and a plunger mounted at a leading end of the actuator rod and having a slanted surface and a slanted surface corresponding to the slanted surface may be formed under the moving block.

The second link may include a first link arm and a second link arm disposed to be separated back and forth along a length direction of the vehicle and each having one end connected to the outside door handle, and a connection arm connecting the other end of the first link arm and the other end of the second link arm.

The first pin shaft may be installed to be protruded from both side faces of the moving block, and the other end of the first link is inserted into the first pin shaft to be rotatably supported.

The second pin shaft may be installed to be protruded from both side surfaces of the moving block, a boss may be provided at the connection arm, and the second pin shaft may be inserted to penetrate the boss so that the second link is rotatably supported via the second pin shaft.

The first pin shaft and the second pin shaft may be connected to each other through a connecting member.

The outside door handle may include a handle housing, a holding hole formed at an upper surface of the handle housing, a boss formed inside the handle housing, to which a pin shaft for rotatably engaging one end of each of the first link arm and the second link arm is coupled, and a boss to which a pin shaft for rotatably engaging one end of the first link is coupled.

One end of the main arm may be rotatably connected to the second link through the pin shaft, and the other end of the main arm may be mounted at the door outer panel to be rotatable.

A return spring may be installed between the main arm and the second link.

A guide groove may be formed under the moving block, and a guide pin inserted into the guide groove to guide the moving block may be further provided.

One side of the emergency lever may be installed at one side of the outside door handle to be rotatable, and the other side of the emergency lever may be installed to be rotatable with respect to the supporting point.

A key cylinder opening and closing the door of the vehicle by a key operation may be further included, and the key cylinder may form the supporting point of the emergency lever.

The guide mechanism may include, a guide protrusion provided at the handle housing; and a guide protrusion portion provided a base plate fixedly mounted on the door outer panel and having a guide groove into which the guide protrusion is inserted to be guided.

The guide protrusion portion may be provided at the base plate to protrude from the inside to the outside along the width direction of the vehicle.

According to the retractable outside door handle assembly for the vehicle according to an exemplary embodiment of the present invention, a stroke of the outside handle may be made longer with a vertically short layout such that connectivity of a door latch may be improved.

Also, since the outside handle is linearly protruded and received, a freedom degree of design may be improved.

In additional, an operation reliability of the outside handle may be improved, rigidity may be increased, and connectivity with other parts such as the door latch is improved, thereby being widely used and reducing a weight and a cost.

DETAILED DESCRIPTION OF ILLUSTRATIVE EMBODIMENTS

Hereinafter, an exemplary embodiment of the present invention will be described in detail with reference to the accompanying drawings.

Figure 1:
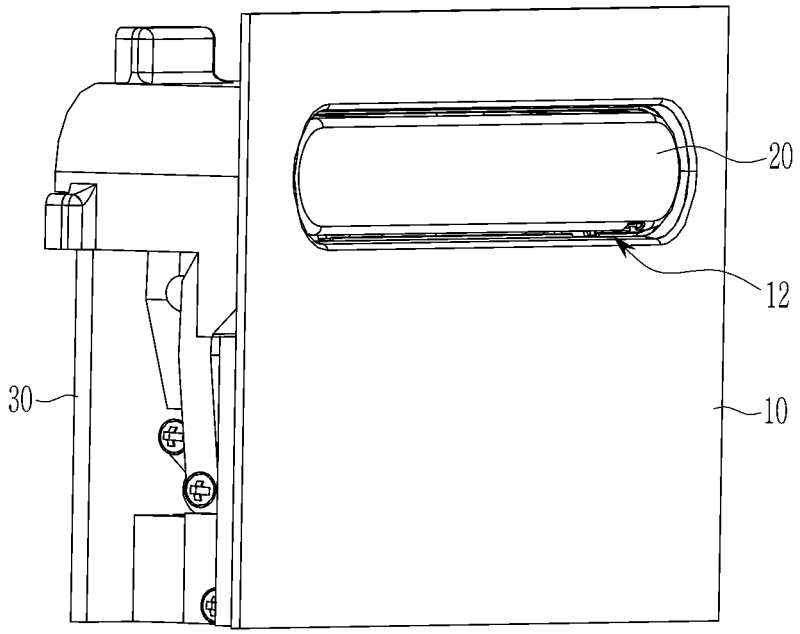
FIG. 1 is a perspective view of a state in which a retractable outside door handle assembly for a vehicle according to an exemplary embodiment of the present invention is mounted on a door outer panel.

Referring to FIG. 1, the retractable outside door handle assembly for the vehicle according to an exemplary embodiment of the present invention may include an outside door handle 20 that is protruded outside in a width direction of a vehicle rather than a door outer panel 10 through an opening 12 formed on a door outer panel 10 or is received in the opening 12 so as to form almost the same plane as an outside surface of the door outer panel 10.

The outside door handle 20 may be installed to be movable in the width direction of the vehicle to a base plate 30 disposed inward in a width direction of the vehicle rather than the door outer panel 10 and mounted at the door outer panel 10 to be fixed.

Figure 2:
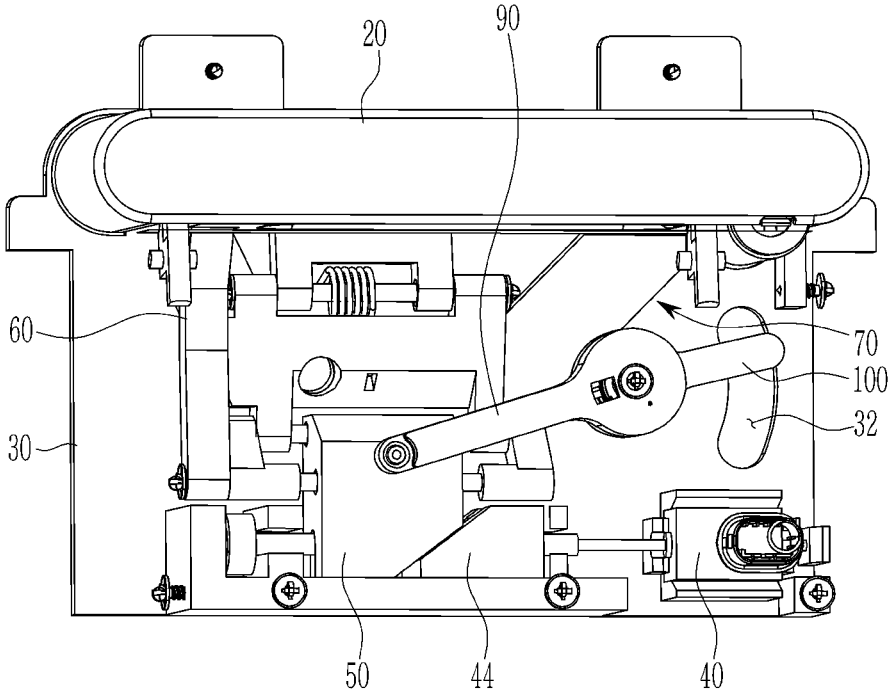
FIG. 2 is a front view of a retractable outside door handle assembly for a vehicle according to an exemplary embodiment of the present invention.
Figure 3:
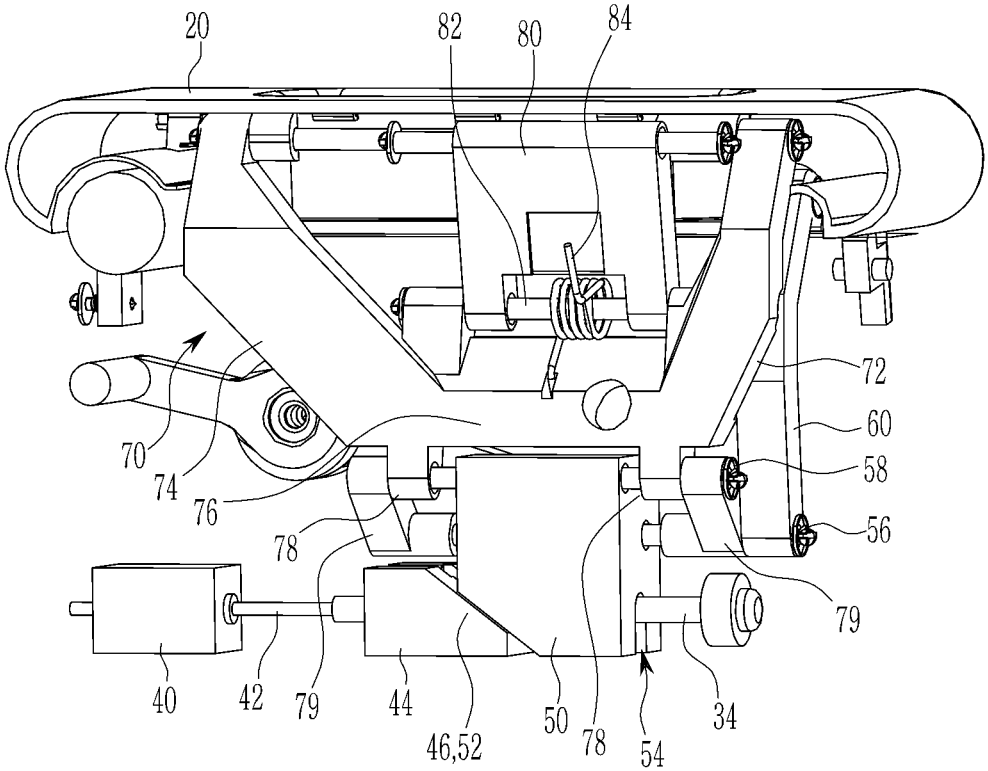
FIG. 3 is a perspective view of a retractable outside door handle assembly for a vehicle according to an exemplary embodiment of the present invention.

Referring to FIG. 2 and FIG. 3, the retractable outside door handle assembly for the vehicle according to an exemplary embodiment of the present invention may further include an actuator 40 that is movable back and forth along the length direction of the vehicle by receiving an electrical signal, and a moving block 50 moving up and down along a height direction of the vehicle by the actuator.

The actuator 40 may include an actuator rod 42 and a plunger 44 mounted at the leading end of the actuator rod 42, and the plunger 44 may provide a slanted surface 46 of which one corner is cut to be slanted while having a polygonal block shape.

A slanted surface 52 corresponding to the slanted surface 46 may also be provided with the shape of which one corner is cut under the moving block 50.

First and second pin shafts 56 and 58 are installed to be protruded from both surfaces of the moving block 50, and one end of a first link 60 may be inserted to the first pin shaft 56 to be rotatably supported.

A second link 70 includes a first link arm 72 and a second link arm 74 disposed to be separated back and forth along the length direction of the vehicle and a connection arm 76 connecting one end of each of the first link arm 72 and the second link arm 74, thereby substantially having a "U" shape, two bosses 78 are provided in the connection arm 76, and the second pin shaft 58 is inserted after passing through the two bosses 78, thereby the second link 70 may also be rotatably supported through the second pin shaft 58.

Also, the first pin shaft 56 and the second pin shaft 58 may be connected to each other through a connecting member 79.

The other end of the first link 60 and the other end of each of the first link arm 72 and the second link arm 74 of the second link 70 may be rotatably connected to the outside door handle 20 through the pin shaft.

Accordingly, the moving of the first and second links 60 and 70 is transmitted to the outside door handle 20 such that the first and second links 60 and 70 and the outside door handle 20 are moved together.

Figure 4:
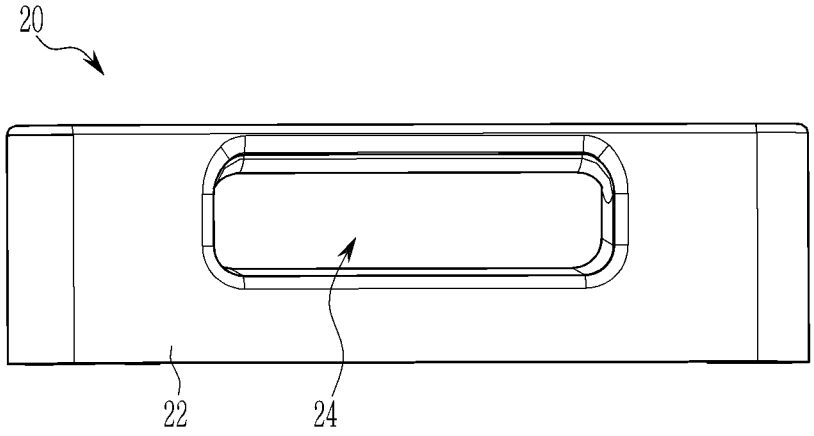
FIG. 4 is a top plan view of an outside door handle according to an exemplary embodiment of the present invention.
Figure 5:
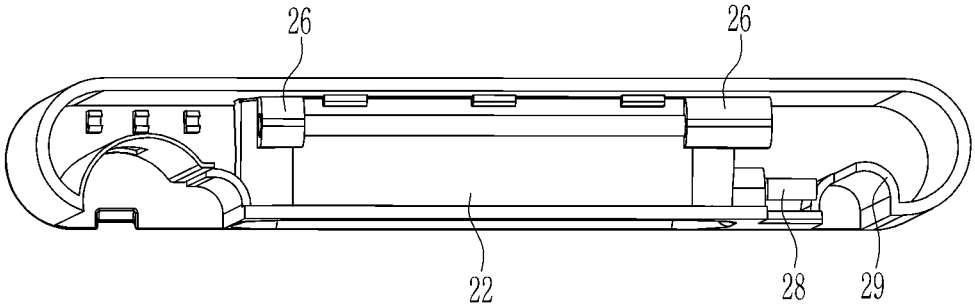
FIG. 5 is a rear view of an outside door handle according to an exemplary embodiment of the present invention.

Referring to FIG. 4 and FIG. 5, the outside door handle 20 may integrally include a handle housing 22, a holding hole 24 formed at the upper surface of the handle housing 22 and capable of receiving a hand of the user for holding the handle housing 22, two bosses 26 to which the pin shaft for rotatably engaging the other end of each of the first link arm 72 and the second link arm 74 to the inside of the handle housing 22 is coupled, and a boss 28 to which the pin shaft for rotatably engaging the other end of the first link 60 is coupled.

In addition, a guide protrusion 29 may be provided at the outside door handle 20 so that the outside door handle 20 can be smoothly horizontally moved in the width direction of the vehicle.

The guide protrusion 29 may have an arc shape cross-section and integrally formed with the handle housing 22.

Figure 6:
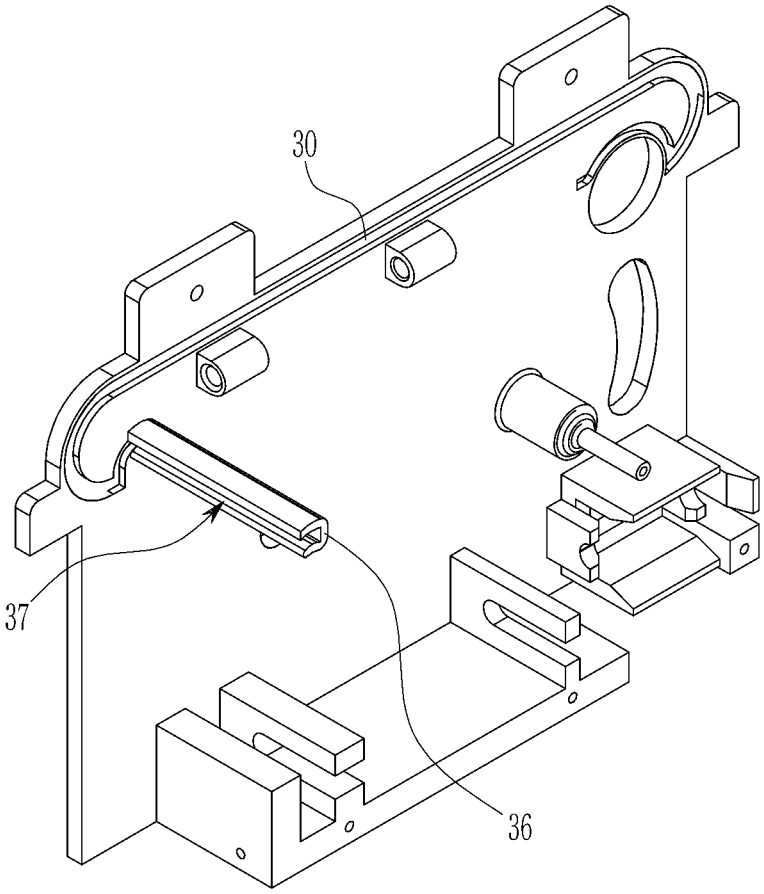
FIG. 6 is a partially perspective view of a base plate according to an exemplary embodiment of the present invention.
Figure 7:
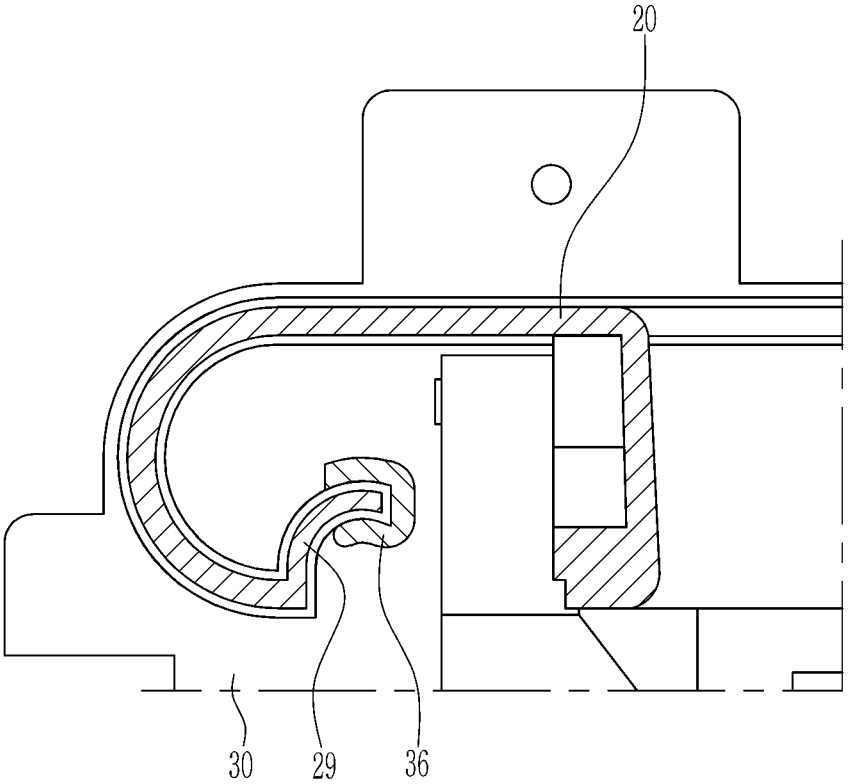
FIG. 7 is a partially cross-sectional view of the state that the base plate and the outside door handle are coupled an exemplary embodiment of the present invention.

Referring FIG. 6 and FIG. 7, a guide protrusion portion 36 having a guide groove 37 into which the guide protrusion 29 of the outside door handle 20 is inserted to be guided, at the base plate 30.

The guide protrusion portion 36 may be formed to be protruded toward the outside of the width direction of the vehicle, and the guide groove 37 may be formed of a channel shape along the length direction of the guide protrusion portion 36.

The guide protrusion 29, the guide groove 37 and the guide protrusion portion 36 may configure a guide mechanism.

According to this, when the outside door handle 20 is popped out of the vehicle or retracted back toward the door outer panel 10, the outside door handle 20 can be guided horizontally along the width direction of the vehicle by cooperation of the guide protrusion 29 and the guide groove 37 in a state that the guide protrusion 29 of the outside door handle 20 is inserted into the guide groove 37 of the base plate 30 and coupled to each other.

Again referring to FIG. 3, one end of a main arm 80 is rotatably connected to the second link 70 through a pin shaft 82 and the other end of the main arm 80 is rotatably mounted at the door outer panel 10, and a return spring 84 is installed between the main arm 80 and the second link 70.

Accordingly, the rotation movement of the second link 70 is limited by the door outer panel 10 through the main arm 80.

Again referring to FIG. 2, one end of a connecter link 90 is engaged to the moving block 50, the other end of the connecter link 90 is connected to a connecter rod 100, and the other end of the connecter rod 100 is inserted into a guide hole 32 with a circular arc shape formed at the base plate 30, thereby being moved along the guide hole 32.

The connecter rod 100 is connected to a door latch (not shown) through a cable, etc., and if the connecter rod 100 is rotated, the door latch may be opened.

Figure 8:
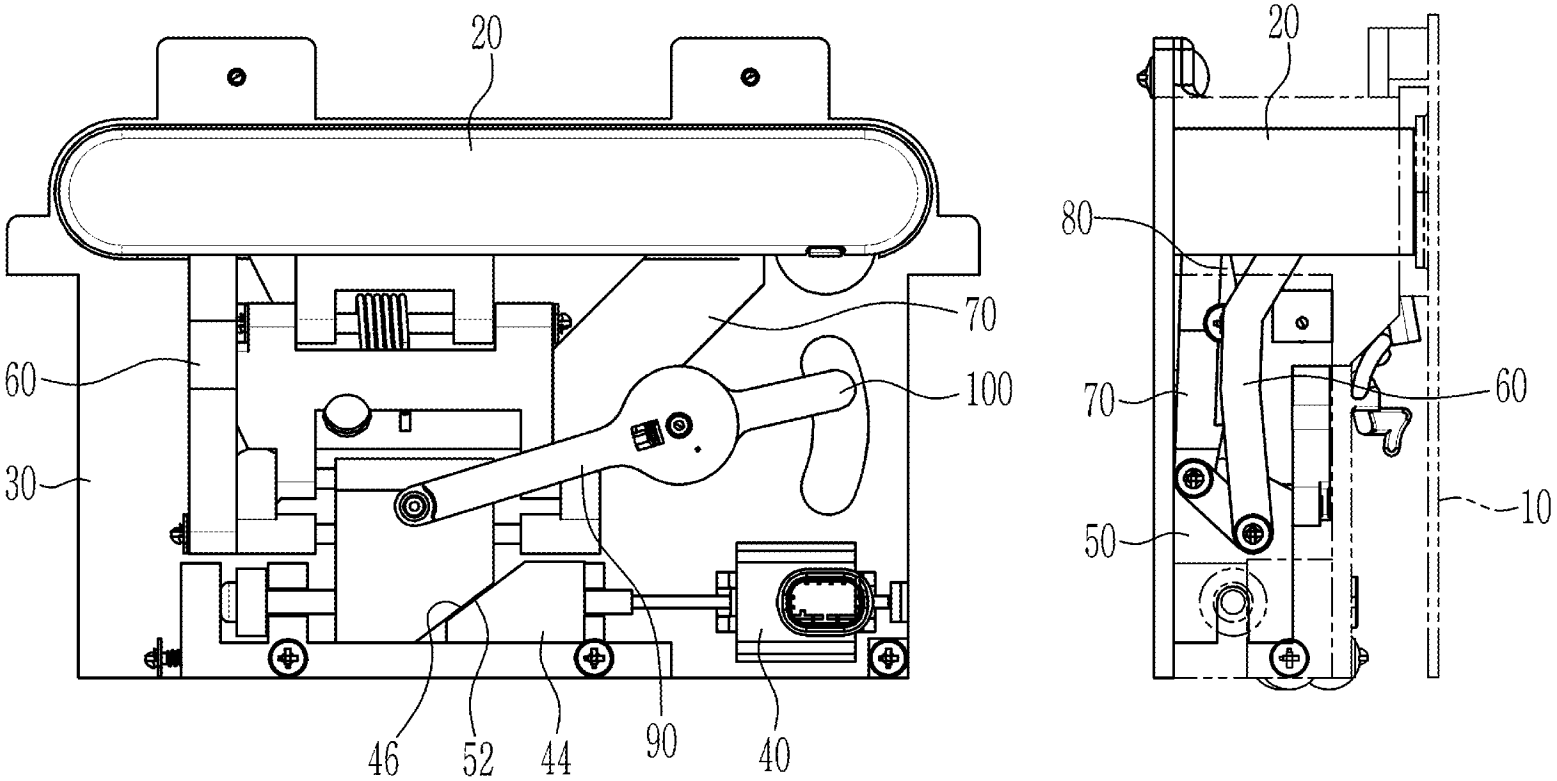
FIGS. 8 to 10 are schematic diagrams describing an operation of a retractable outside door handle assembly for a vehicle according to an exemplary embodiment of the present invention.
Figure 9:
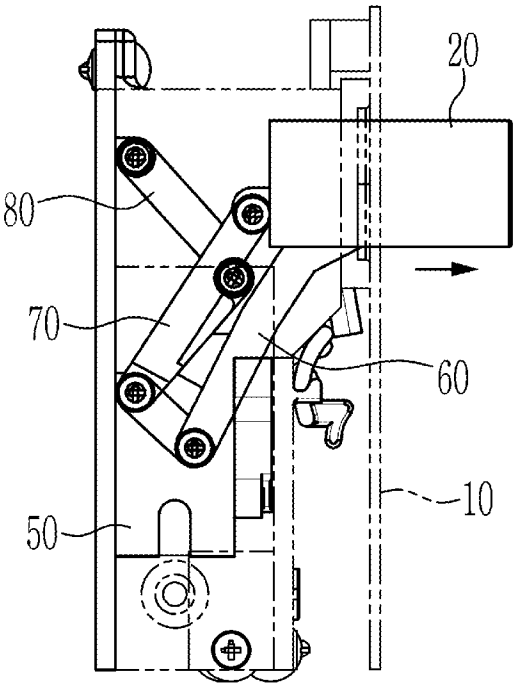
Figure 9:
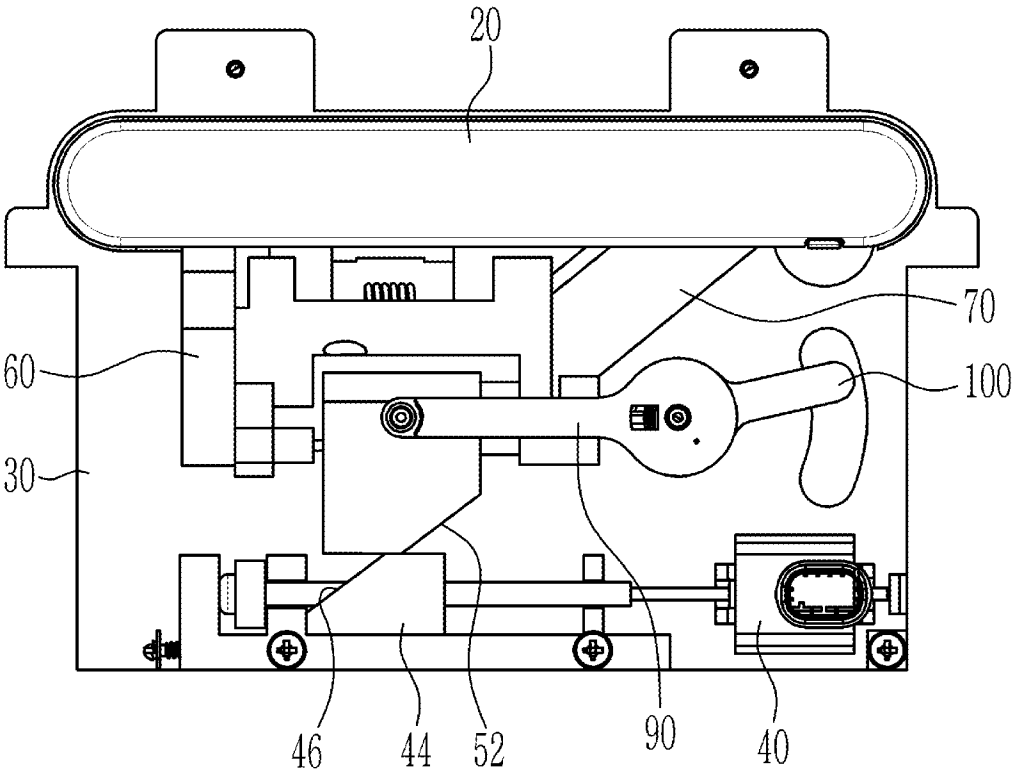
Figure 10:
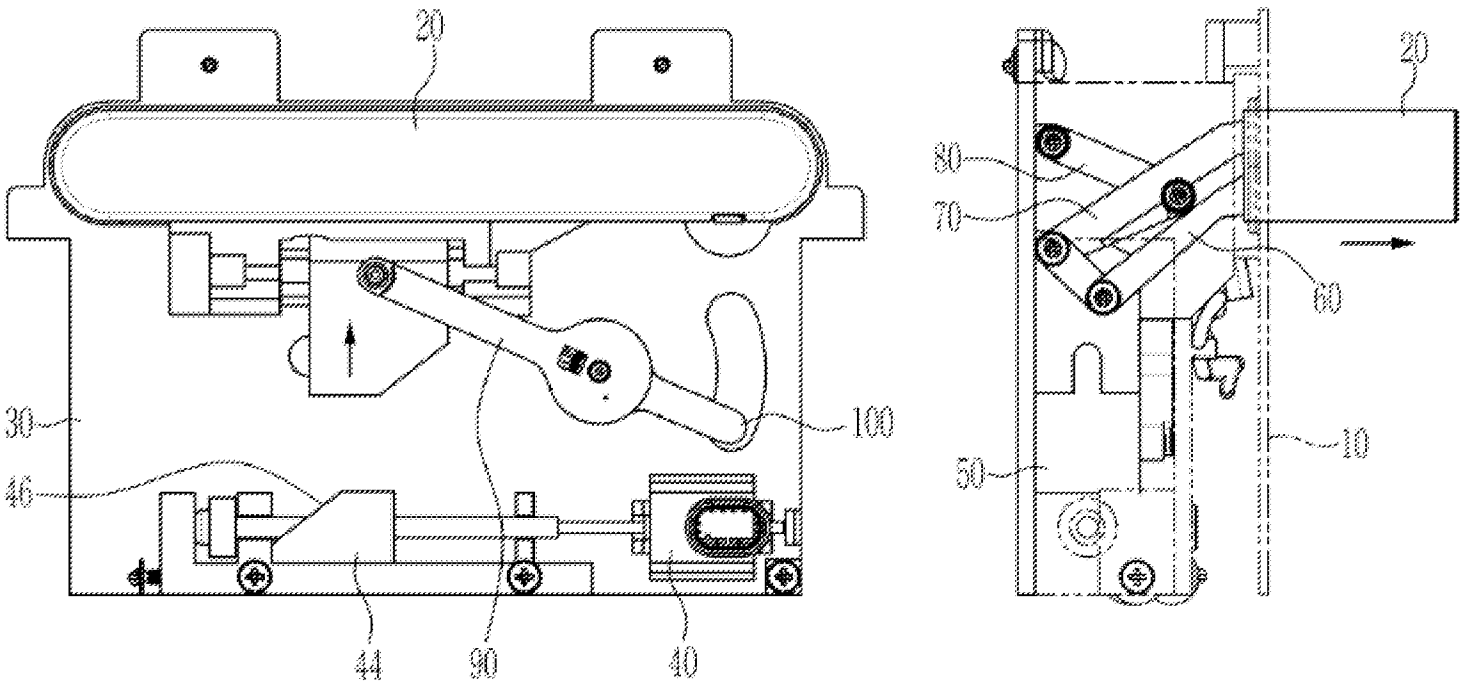

Referring to FIGS. 8 to 10, FIG. 8 shows a state in which the outside door handle 20 is received inside the opening 12 of the door outer panel 10.

That is, the state in which the door is closed is shown.

When the driver approaches the vehicle such that the actuator 40 receives to be operated, as shown in FIG. 9, as the plunger 44 moves forward along the length direction of the vehicle, the moving block 50 is pushed up in the height direction of the vehicle by the mutual operation of the slanted surface 46 of the plunger 44 and the slanted surface 52 of the moving block 50.

Also, the first link 60 and second link 70 connected to the moving block 50 rise together as the moving block 50 rises.

If the first link 60 and the second link 70 rise, since the second link 70 is rotatably connected to the main arm 80 by the pin and the main arm 80 is rotatably connected to the door outer panel 10, as the second link 70 rotatably moves outward in the width direction of the vehicle, and simultaneously the first link 60 also rotatably moves outward in the width direction of the vehicle, the outside door handle 20 connected to the first link 60 and the second link 70 is protruded outward in the width direction of the vehicle rather than the door outer panel 10.

In this process, the connecter link 90 connected to the moving block 50 is rotated in a clockwise direction, however the rotation movement of the connecter link 90 is not transmitted to the connecter rod 100 such that the connecter rod 100 is not rotated.

In the state in which the moving block 50 climbs on the upper surface of the plunger 44 such that the raising of the moving block 50 by the plunger 44 is completed, that is, the outside door handle 20 is protruded outside the door outer panel 10, when the user puts a hand into the holding hole 24 of the outside door handle 20 and pulls the outside door handle 20 outward in the width direction of the vehicle, as shown in FIG. 8, the outside door handle 20 is pulled outward in the width direction of the vehicle and the first and second links 60 and 70 are also rotatably moved in the clockwise direction, and the moving block 50 also further rises.

In this process, as the connecter link 90 is also rotated in the clockwise direction and the rotation movement of the connecter link 90 is transmitted to the connecter rod 100, the connecter rod 100 moves along the guide hole 32 formed in the base plate 30 to release the door latch connected to the connecter rod 100, thereby the door is opened.

On the other hand, after the door is opened according to the operation of the connecter rod 100, if the user releases the outside door handle 20, the main arm 80 is rotated to its original position by the elastic restoring force of the return spring 84, the outside door handle 20 is inserted inside the opening 12 of the door outer panel 10 by the rotation of the main arm 80, and the moving block 50 is lowered to the initial position.

In the raising and lowering process of the moving block 50, for smooth raising and correct original position restoration of the moving block 50, as shown in FIG. 2 and FIG. 3, a guide groove 54 of a shape that is recessed inside the moving block 50 is formed under the moving block 50, and a guide pin 34 inserted into the guide groove 54 is installed at the base plate 30.

That is, in the rising and falling process of the moving block 50, the guide groove 54 of the moving block 50 is inserted to the guide pin 34, thereby guiding the movement of the moving block 50.

Figure 11:
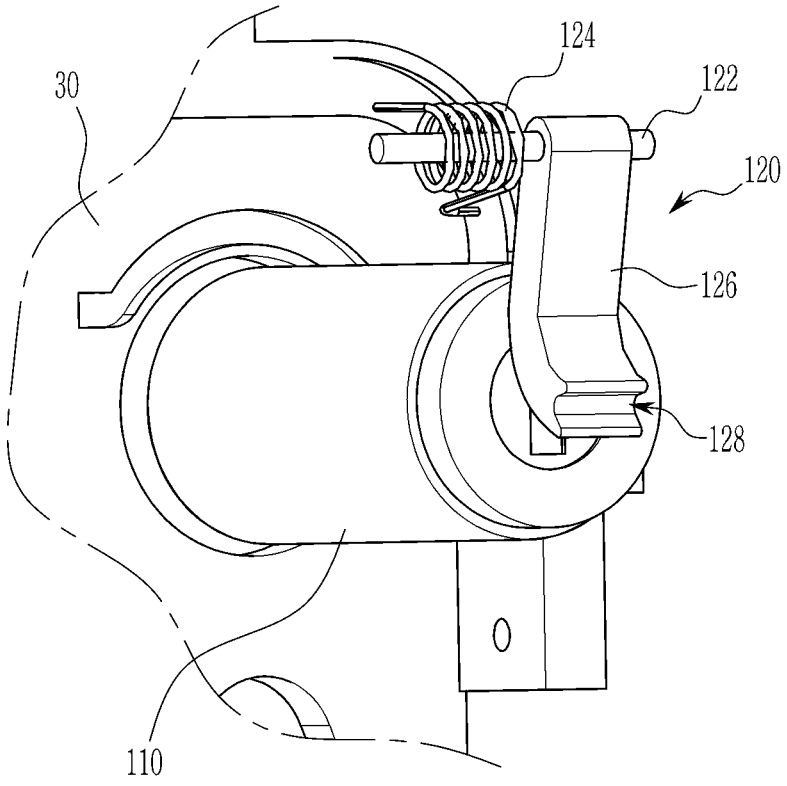
FIG. 11 is a perspective view of an emergency lever according to an exemplary embodiment of the present invention.

Referring to FIG. 11, when a smart key of the vehicle or the actuator 40 is not operated, to open the door by the key of the general vehicle, a key cylinder no may be mounted at the base plate 30.

Also, if the actuator 40 is inoperative, when it is not possible to protrude the outside door handle 20 via the actuator 40, an emergency lever 120 may be further provided so that the user of the vehicle may manually protrude the outside door handle 20.

The emergency lever 120 is installed at the outside door handle 20 to be rotatable via its hinge axis 122, and a return spring 124 may be installed with a rewinding shape for returning the emergency lever 120 to the original position at the hinge axis 122 after the operation of the emergency lever 120.

The emergency lever 120 may include a lever body 126 that is substantially bent with an obtuse angle and a tool groove 128 formed at one end of the lever body 126, and the hinge axis 122 is inserted to be penetrated at the other end of the lever body 126.

When the emergency lever 120 is disposed to approach the key cylinder no and the emergency lever 120 is rotated with respect to its hinge axis 122, the key cylinder no may function at a supporting point of the lever body 126.

Figure 12:
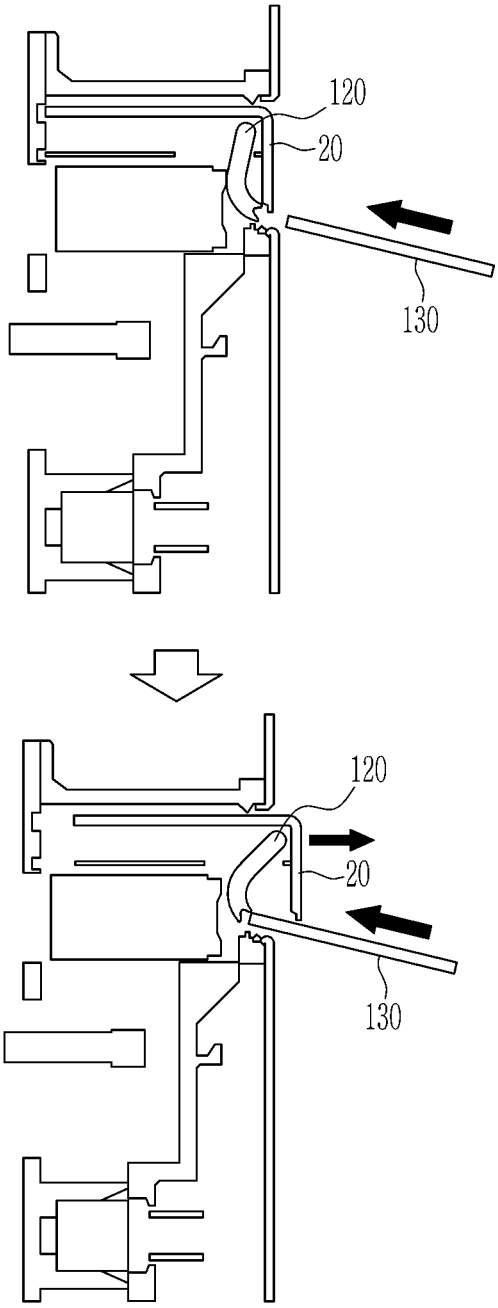
FIG. 12 is a cross-sectional view describing an operation of an emergency lever according to an exemplary embodiment of the present invention.

That is, as shown in FIG. 12, when the vehicle user can not open the door for the reason described above, if a tool 130 such as a rod having a thin thickness is inserted into a gap between the opening 12 and the outside door handle 20 to push the emergency lever 120, part of the emergency lever 120 is in contact with a supporting point of the key cylinder no so that the emergency lever 120 is rotated in the clockwise via the supporting point, and accordingly, as one side of the outside door handle 20 is pushed outward in the width direction of the vehicle by the emergency lever 120 to be slightly protruded from the opening 12, the vehicle user holds the protruded outside door handle 20 to be pulled outward in the width direction of the vehicle, thereby opening the door.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A retractable outside door handle assembly for a vehicle, the retractable outside door handle assembly comprising:

an outside door handle protruded outward in a width direction of the vehicle further than a door outer panel configuring a door of the vehicle or being receivable to an opening formed at the door outer panel;

a first link having one end connected to one end of the outside door handle and an other end extending downward along a height direction of the vehicle;

a second link having one end connected to one side and another side of the outside door handle and an other end extending along the height direction of the vehicle;

a main arm having one end rotatably connected to the door outer panel and an other end connected to the second link;

a moving block connected to the other end of the first link and the other end of the second link and movable up and down along the height direction of the vehicle; and a guide mechanism for guiding movement of the outside door handle along the width direction of the vehicle.

2. The retractable outside door handle assembly of claim 1, further comprising an actuator pushing up the moving block along the height direction of the vehicle.

3. The retractable outside door handle assembly of claim 2, wherein the actuator includes:

an actuator rod;

a plunger mounted at a leading end of the actuator rod and having a slanted surface; and a slanted surface corresponding to the slanted surface that is formed under the moving block.

4. The retractable outside door handle assembly of claim 1, wherein:

one end of the main arm is rotatably connected to the second link through a pin shaft; and another end of the main arm is mounted at the door outer panel to be rotatable.

5. The retractable outside door handle assembly of claim 1, wherein a return spring is installed between the main arm and the second link.

6. The retractable outside door handle assembly of claim 1, wherein:

a guide groove is formed under the moving block; and a guide pin inserted into the guide groove to guide the moving block is further provided.

7. The retractable outside door handle assembly of claim 1, further comprising an emergency lever installed at the outside door handle.

8. The retractable outside door handle assembly of claim 7, wherein:

one side of the emergency lever is installed at one side of the outside door handle to be rotatable; and another side of the emergency lever is installed to be rotatable with respect to a supporting point.

9. The retractable outside door handle assembly of claim 7, further comprising a key cylinder opening forming a supporting point of the emergency lever.

10. A retractable outside door handle assembly for a vehicle, the retractable outside door handle assembly comprising:

an outside door handle protruded outward in a width direction of the vehicle further than a door outer panel configuring a door of the vehicle or being receivable to an opening formed at the door outer panel;

a first link having one end connected to one end of the outside door handle and an other end extending downward along a height direction of the vehicle;

a second link having one end connected to one side and another side of the outside door handle and an other end extending along the height direction of the vehicle;

a main arm having one end rotatably connected to the door outer panel and an other end connected to the second link;

a moving block connected to the other end of the first link and the other end of the second link and movable up and down along the height direction of the vehicle; and a guide mechanism for guiding movement of the outside door handle along the width direction of the vehicle;

wherein the second link includes:

a first link arm and a second link arm disposed to be separated back and forth along a length direction of the vehicle and the first and second link arms having one end connected to the outside door handle; and a connection arm connecting the other end of the first link arm and the other end of the second link arm.

11. The retractable outside door handle assembly of claim 10, further comprising a first pin shaft installed to be protruded from both side faces of the moving block, and the other end of the first link is connected with the first pin shaft to be rotatably supported.

12. The retractable outside door handle assembly for the vehicle of claim 11, wherein:

a second pin shaft is installed to be protruded from both side faces of the moving block;

a boss is provided at the connection arm; and the second pin shaft is inserted to penetrate the boss so that the second link is rotatably supported via the second pin shaft.

13. The retractable outside door handle assembly of claim 12, wherein the first pin shaft and the second pin shaft are connected to each other through a connecting member.

14. The retractable outside door handle assembly of claim 10, wherein the outside door handle includes:

a handle housing;

a holding hole formed at an upper surface of the handle housing;

a first boss formed inside the handle housing, to which a first pin shaft for rotatably engaging one end of each of the first link arm and the second link arm is coupled; and a second boss to which a second pin shaft for rotatably engaging one end of the first link is coupled.

15. The retractable outside door handle assembly of claim 14, wherein the guide mechanism comprises:

a guide protrusion provided at the handle housing; and a guide protrusion portion provided at a base plate fixedly mounted on the door outer panel and having a guide groove into which the guide protrusion is inserted to be guided.

16. The retractable outside door handle assembly of claim 15, wherein the guide protrusion portion may be provided at the base plate to protrude from inside to outside along the width direction of the vehicle.

17. A vehicle comprising:

a vehicle body having a cabin formed therein;

a door for opening/closing the cabin;

an outside door handle protruded outward in a width direction of the vehicle further than a door outer panel configuring the door of the vehicle or being receivable to an opening formed at the door outer panel;

a first link having one end connected to one end of the outside door handle and an other end extending downward along a height direction of the vehicle;

a second link having one end connected to one side and another side of the outside door handle and an other end extending along the height direction of the vehicle;

a main arm having one end rotatably connected to the door outer panel and an other end connected to the second link;

a moving block connected to the other end of the first link and the other end of the second link and movable up and down along the height direction of the vehicle; and a guide mechanism for guiding movement of the outside door handle along the width direction of the vehicle.

18. The vehicle of claim 17, wherein the second link includes:

a first link arm and a second link arm disposed to be separated back and forth along a length direction of the vehicle and the first and second link arms having one end connected to the outside door handle; and a connection arm connecting the other end of the first link arm and the other end of the second link arm.

19. The vehicle of claim 18, further comprising:

a first pin shaft installed to be protruded from both side faces of the moving block, and the other end of the first link is connected with the first pin shaft to be rotatably supported;

a second pin shaft installed to be protruded from both side faces of the moving block; and a boss provided at the connection arm, the second pin shaft being inserted to penetrate the boss so that the second link is rotatably supported via the second pin shaft.

20. The vehicle of claim 18, wherein the outside door handle includes:

a handle housing;

a holding hole formed at an upper surface of the handle housing;

a first boss formed inside the handle housing, to which a first pin shaft for rotatably engaging one end of each of the first link arm and the second link arm is coupled; and a second boss to which a second pin shaft for rotatably engaging one end of the first link is coupled.

* * * * *